US010912700B2

(12) United States Patent
Chuang

(10) Patent No.: US 10,912,700 B2
(45) Date of Patent: Feb. 9, 2021

(54) VIBRATING FAT ELIMINATING DEVICE

(71) Applicant: Lung-Fei Chuang, Taichung (TW)

(72) Inventor: Lung-Fei Chuang, Taichung (TW)

( * ) Notice: Subject to any disclaimer, the term of this patent is extended or adjusted under 35 U.S.C. 154(b) by 341 days.

(21) Appl. No.: 15/905,775

(22) Filed: Feb. 26, 2018

(65) Prior Publication Data

US 2019/0183712 A1 Jun. 20, 2019

(30) Foreign Application Priority Data

Dec. 15, 2017 (TW) ..... 106218690 U

(51) Int. Cl.

| | |
|---|---|
| ***A61H 1/00*** | (2006.01) |
| ***A61H 23/02*** | (2006.01) |
| ***A63B 22/16*** | (2006.01) |
| ***A63B 21/00*** | (2006.01) |

(52) U.S. Cl.

CPC ..... *A61H 1/005* (2013.01); *A61H 23/02* (2013.01); *A61H 2201/0107* (2013.01);
(Continued)

(58) Field of Classification Search

CPC ..... A61H 1/005; A61H 23/02; A61H 2201/0107; A61H 2201/0134; A61H 2201/0138; A61H 2201/0149; A61H 2201/0173; A61H 2201/1633; A61H 2201/1635; A61H 2201/1638; A61H 2201/164; A61H 2201/1642; A61H 2201/5038; A61H 2201/5043; A61H 2203/0406; A61H 2203/0425;
(Continued)

(56) References Cited

U.S. PATENT DOCUMENTS 3,036,487 A * 5/1962 Hughes ..... F16B 21/16 411/352
5,533,784 A 7/1996 Fukuoka
(Continued)

FOREIGN PATENT DOCUMENTS

DE 202016104715 U1 9/2016
EP 3231408 A1 10/2017
(Continued)

OTHER PUBLICATIONS

English translation of EP 3,231,408 B1; Jeske Petra, EP_3231408_B1_Translation, Oct. 18, 2017, all pages (Year: 2017).*

*Primary Examiner* — Tu A Vo
*Assistant Examiner* — Alexander Morales
(74) *Attorney, Agent, or Firm* — CKC & Partners Co., LLC

(57) ABSTRACT

A vibrating fat eliminating device includes a vibrating mainbody, a chair body and a positioning unit. The vibrating mainbody includes a fixing notch and an upper surface, wherein the fixing notch is disposed on the upper surface. The chair body is detachably disposed on the vibrating mainbody and includes a supporting frame and a cushion, wherein the supporting frame is disposed on the upper surface, the cushion is disposed on the supporting frame, and the supporting frame includes a connecting portion having a through hole. The positioning unit passes through the through hole and is connected to the fixing notch correspondingly, wherein the chair body is detachably disposed on the upper surface via the positioning unit.

9 Claims, 8 Drawing Sheets

(52) U.S. Cl.
CPC ..... *A61H 2201/0138* (2013.01); *A61H 2201/0149* (2013.01); *A61H 2201/164* (2013.01); *A61H 2201/1633* (2013.01); *A61H 2201/1635* (2013.01); *A61H 2201/1638* (2013.01); *A61H 2201/1642* (2013.01); *A61H 2201/5038* (2013.01); *A61H 2201/5043* (2013.01); *A61H 2203/0406* (2013.01); *A61H 2203/0425* (2013.01); *A61H 2203/0431* (2013.01); *A63B 21/00196* (2013.01); *A63B 21/4037* (2015.10); *A63B 22/16* (2013.01); *A63B 2208/0204* (2013.01); *A63B 2208/0233* (2013.01)

(58) Field of Classification Search
CPC ..... A61H 2203/0431; A61H 2205/08; A61H 2205/106; A61H 2207/00; A63B 21/00196; A63B 21/4037; A63B 22/16; A63B 2208/0204; A63B 2208/0233
See application file for complete search history.

(56) References Cited

U.S. PATENT DOCUMENTS

| | | | | |
|---|---|---|---|---|
| 5,716,331 | A | 2/1998 | Chang | |
| 2008/0300520 | A1* | 12/2008 | Shin | A61H 1/003 601/49 |
| 2011/0081218 | A1* | 4/2011 | Wang | F16B 5/0208 411/120 |
| 2012/0093609 | A1* | 4/2012 | Trifilio | B25B 23/00 411/103 |
| 2014/0162852 | A1* | 6/2014 | Ho | A63B 21/023 482/127 |
| 2015/0305957 | A1* | 10/2015 | Triplett | A61H 1/005 601/53 |

FOREIGN PATENT DOCUMENTS

| | | | |
|---|---|---|---|
| KR | 20140142073 | A | 12/2014 |
| WO | 2009093791 | A1 | 7/2009 |

* cited by examiner

VIBRATING FAT ELIMINATING DEVICE

RELATED APPLICATIONS

This application claims priority to Taiwan Application Serial Number 106218690, filed Dec. 15, 2017, which is herein incorporated by reference.

BACKGROUND

Technical Field

The present disclosure relates to a vibrating fat eliminating device. More particularly, the present disclosure relates to a vibrating fat eliminating device including a chair body.

Description of Related Art

As the advance of the modern society, people pay more attention to their own health and appearance. Accordingly, body training and massage devices which can promote the body metabolism and achieve the training effect are developed.

In recent years, a vibrating fat eliminating device having a simple structure and being easy to use is outstanding compared with other training devices and is popular with bodybuilders. However, for the physically weak person or the elderly, it is difficult to maintain standing posture for a long time, and furthermore the conventional vibrating fat eliminating devices use vibration to achieve the body training or massage effects, so maintaining standing posture during the whole training process is extremely difficult for the person whose lower limbs are weak. Therefore, for the person who is difficult to maintain the standing posture for a long time on the vibrating fat eliminating device, the using time of the vibrating fat eliminating device should be shortened, which will greatly reduce the effects of body training or massage.

Therefore, developing a vibrating fat eliminating device which is suitable for the aforementioned people has become the major aim of the people in the related business.

SUMMARY

The present disclosure provides a vibrating fat eliminating device including a vibrating mainbody, a chair body and a positioning unit. The vibrating mainbody includes a fixing notch and an upper surface, wherein the fixing notch is disposed on the upper surface. The chair body is detachably disposed on the vibrating mainbody and includes a supporting frame and a cushion, wherein the supporting frame is disposed on the upper surface, the cushion is disposed on the supporting frame, and the supporting frame includes a connecting portion having a through hole. The positioning unit passes through the through hole and is connected to the fixing notch correspondingly, wherein the chair body is detachably disposed on the upper surface via the positioning unit.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
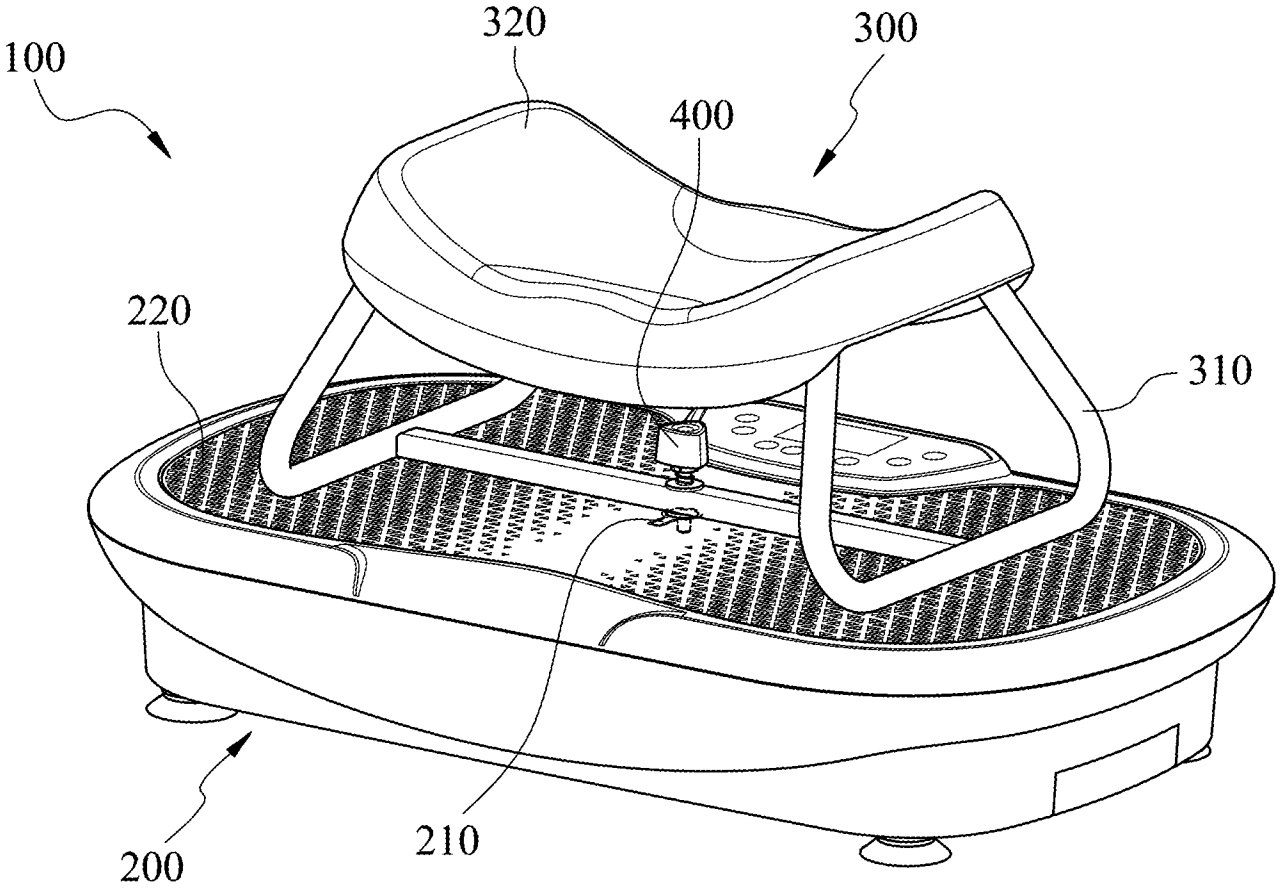
FIG. 1 is a schematic view of a vibrating fat eliminating device according to one embodiment of the present disclosure.
Figure 2A:
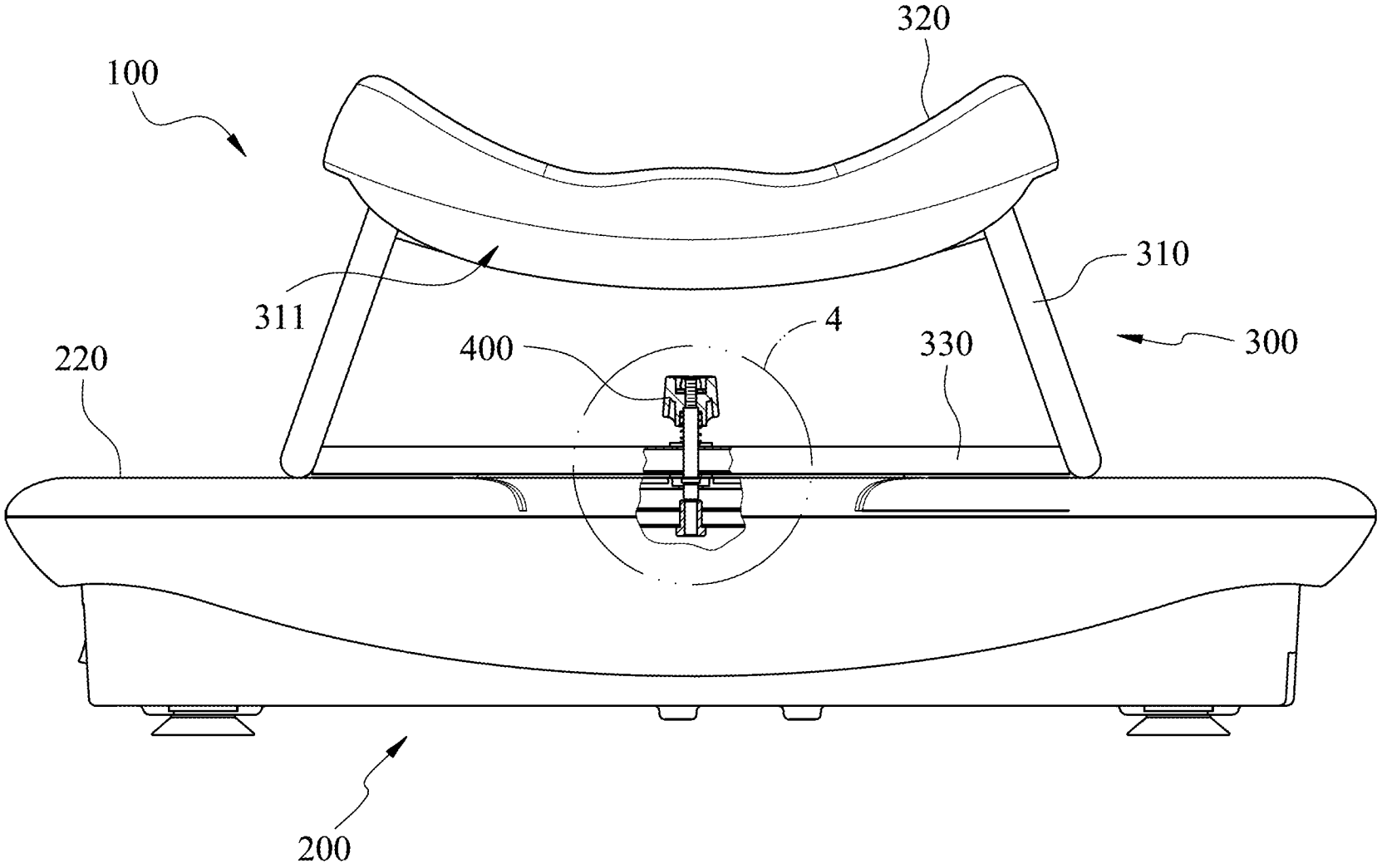
FIG. 2A is a side view of the vibrating fat eliminating device of FIG. 1.
Figure 2B:
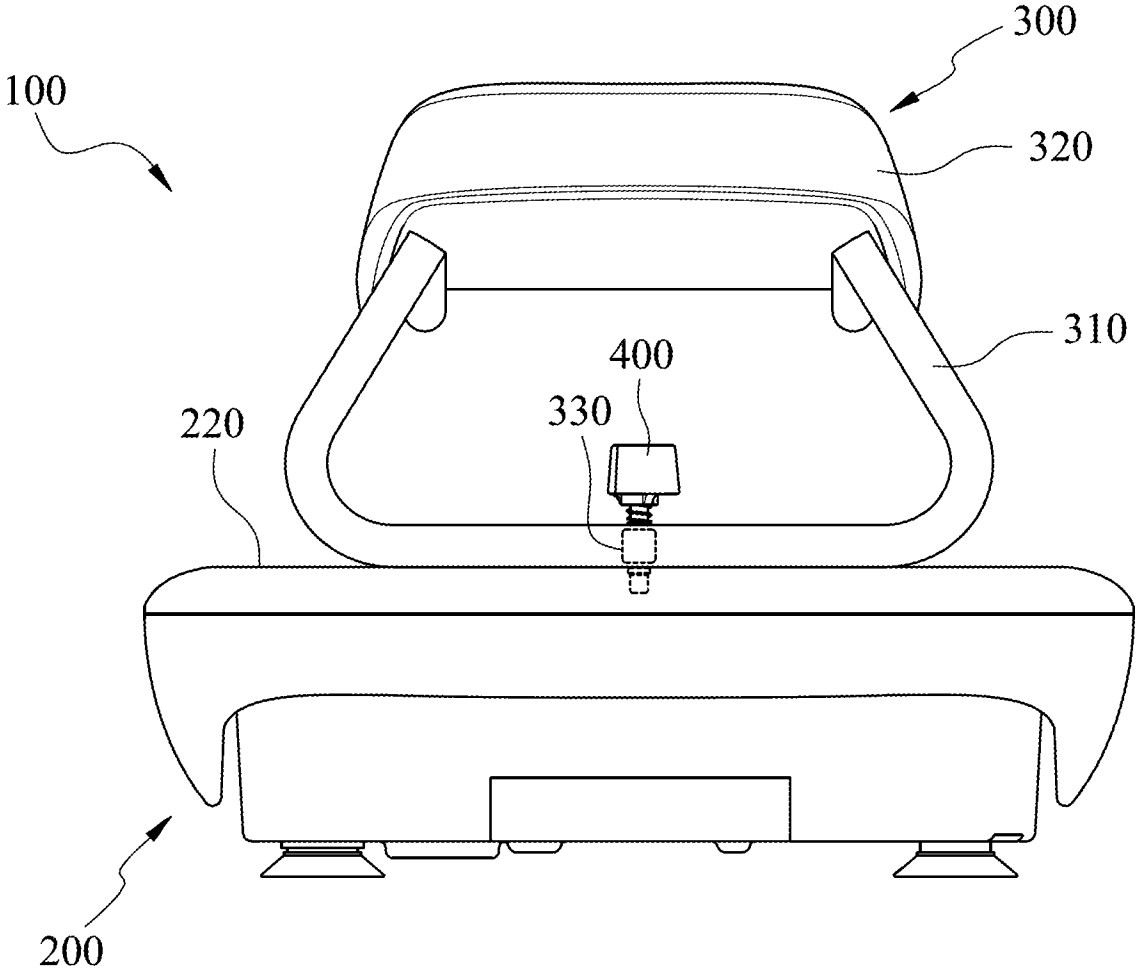
FIG. 2B is another side view of the vibrating fat eliminating device of FIG. 1.

FIG. 1 is a schematic view of a vibrating fat eliminating device 100 according to one embodiment of the present disclosure. FIG. 2A is a side view of the vibrating fat eliminating device 100 of FIG. 1. FIG. 2B is another side view of the vibrating fat eliminating device 100 of FIG. 1. As shown in FIG. 1, FIG. 2A and FIG. 2B, the vibrating fat eliminating device 100 includes a vibrating mainbody 200, a chair body 300 and a positioning unit 400 (reference number is shown in FIG. 2A and FIG. 2B).

The vibrating mainbody 200 includes a fixing notch 210 and an upper surface 220, wherein the fixing notch 210 is disposed on a center of the upper surface 220. A vibrating center of the vibrating fat eliminating device 100 is a center of the vibrating mainbody 200, so that the fixing notch 210 disposed on the center of the upper surface 220 of the vibrating mainbody 200 is favorable for disposing the chair body 300 on the vibrating center of the vibrating fat eliminating device 100. Therefore, it is favorable for transmitting the vibrating wave during the operation of the vibrating fat eliminating device 100 so as to enhance the efficiency of body training or massage.

Figure 4:
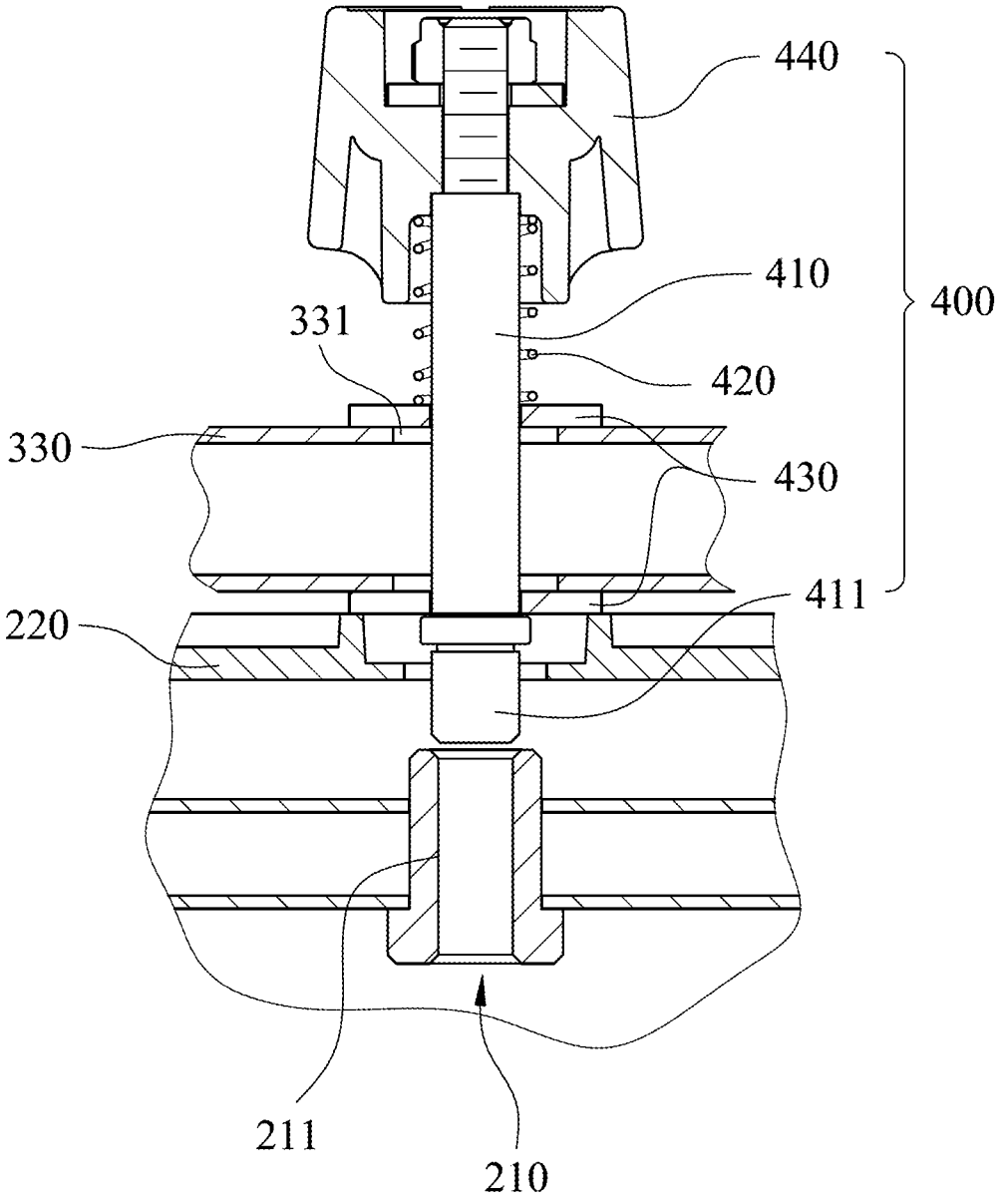
FIG. 4 is an enlarged cross-sectional view of the positioning unit connecting with a vibrating mainbody of FIG. 2A.

The chair body 300 is detachably disposed on the vibrating mainbody 200 and includes a supporting frame 310 and a cushion 320, wherein the supporting frame 310 is disposed on the upper surface 220, the cushion 320 is disposed on the supporting frame 310, and the supporting frame 310 includes a connecting portion 330 having a through hole 331 (reference number is shown in FIG. 4). Therefore, the disposition of the chair body 300 can provide a seating place on the vibrating fat eliminating device 100 so that the user can use the vibrating fat eliminating device 100 in a sitting posture for the body training or massage. Furthermore, the vibrating fat eliminating device 100 including the detachable chair body 300 can also provide the user with different body training or massage modes. When the chair body 300 is detached from the vibrating mainbody 200, the user can stand directly on the vibrating mainbody 200 so as to train or massage the lower limbs. On the other hand, when the chair body 300 is disposed on the vibrating mainbody 200, the user can sit on the chair body 300 so as to train or massage the torso.

As shown in FIG. 2A, the supporting frame 310 has an arc portion 311, a shape of the cushion 320 is arc-shaped corresponding to the arc portion 311, and the cushion 320 is disposed on the arc portion 311. Therefore, the chair body 300 can be suitable for the hip shape when the user sits thereon, so that the demands of high vibration transmitting rate and the using safety of the vibrating fat eliminating device 100 of the present disclosure can be both satisfied. However, it must be noted that the shape of the cushion 320 can also be designed as plane-shaped instead of arc-shaped, and will not be limited thereto.

Figure 3:
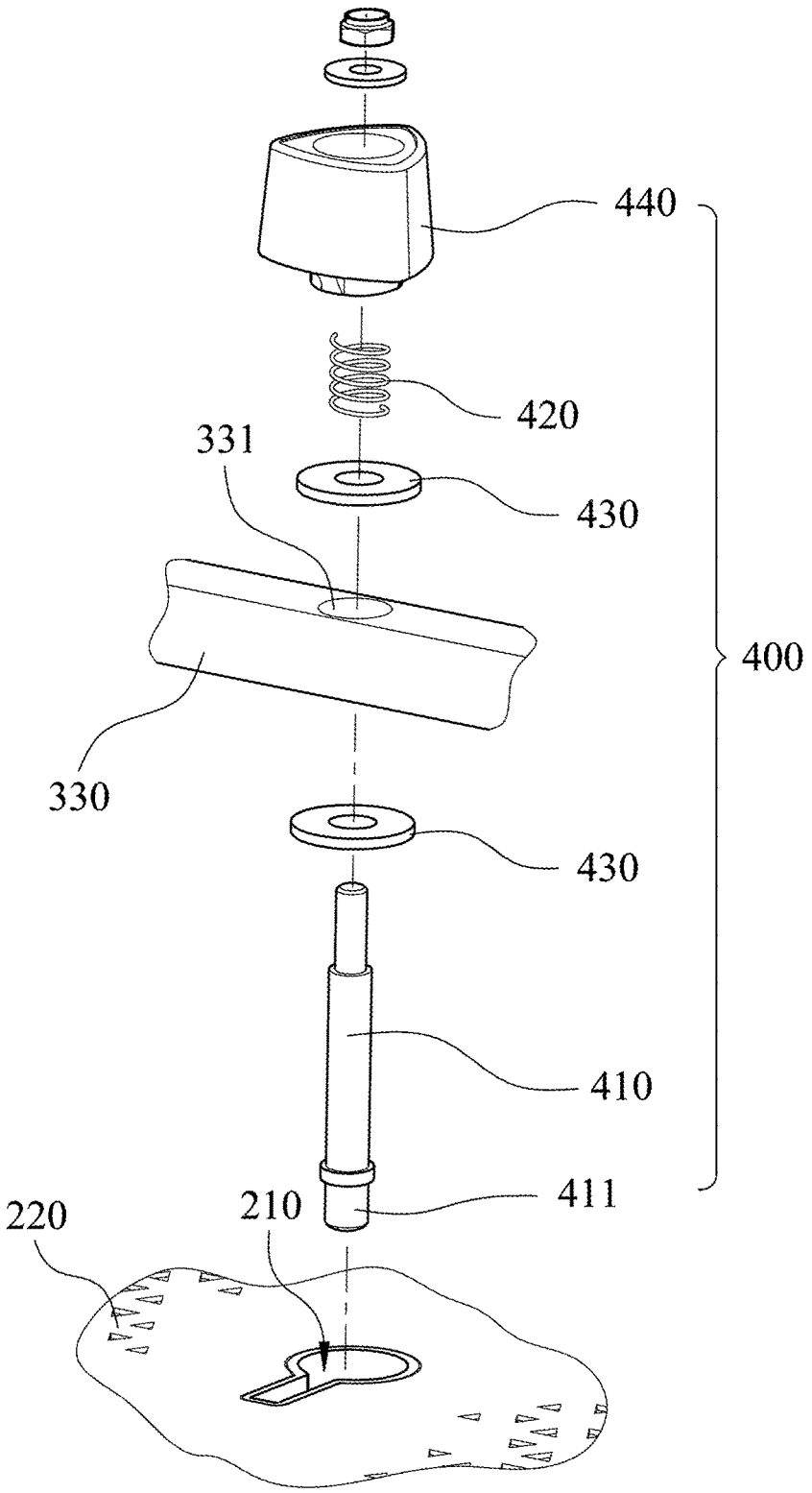
FIG. 3 is an assembling schematic view of a positioning unit of FIG. 1.

The positioning unit 400 passes through the through hole 331 (reference number is shown in FIG. 3) and is connected to the fixing notch 210 correspondingly, and the chair body 300 is detachably disposed on the upper surface 220 via the positioning unit 400. Therefore, using the single positioning unit 400 to dispose the chair body 300 on the vibrating mainbody 200 can greatly reduce the assembling complexity of the chair body 300. Furthermore, the vibrating fat eliminating device 100 can provide a seating place by the disposition of the chair body 300 on the vibrating mainbody 200 via the positioning unit 400, so that the user can use the vibrating fat eliminating device 100 without maintaining a standing posture for a long time so as to achieve the purposes of body training or massage.

FIG. 3 is an assembling schematic view of the positioning unit 400 of FIG. 1. FIG. 4 is an enlarged cross-sectional view of the positioning unit 400 connecting with the vibrating mainbody 200 of FIG. 2A. As shown in FIG. 3, the positioning unit 400 includes a fixing rod 410, an elastic member 420 and two washers 430, and in the embodiment of FIG. 3, the elastic member 420 is a spring. When the vibrating fat eliminating device 100 is under assembling, the fixing rod 410 passes through in order from the elastic member 420, one of the washers 430, the through hole 331 of the connecting portion 330 of the chair body 300, and the other one of the washers 430, and then is connected to the fixing notch 210 of the vibrating mainbody 200. As shown in FIG. 4, the fixing notch 210 is disposed on the upper surface 220 of the vibrating mainbody 200 and depressed from the upper surface 220. The fixing notch 210 includes an internal connecting portion 211, and the fixing rod 410 of the positioning unit 400 includes a connecting end 411. After the fixing rod 410 passing through the elastic member 420, one of the washers 430, the through hole 331 and the other one of the washers 430 sequentially, the fixing rod 410 passes into the fixing notch 210 so as to connect the connecting end 411 with the internal connecting portion 211, the chair body 300 is disposed on the center of the vibrating mainbody 200 accordingly and provide a seating place on the vibrating fat eliminating device 100, and it is favorable for transmitting the vibrating wave during the operation of the vibrating fat eliminating device 100. It must be noted that the positioning unit 400 can be connected with the vibrating mainbody 200 not only by the tabling method but also by the locking method, and the connection between the positioning unit 400 and the vibrating mainbody 200 will not be limited thereto. The positioning unit 400 can further include a knob 440 disposed on one side of the fixing rod 410 which is different from the connecting end 411. Therefore, the chair body 300 can be disposed on the vibrating mainbody 200 without using other hand tools by the disposition of the knob 440 so as to enhance the assembling convenience of the vibrating fat eliminating device 100.

Figure 5:
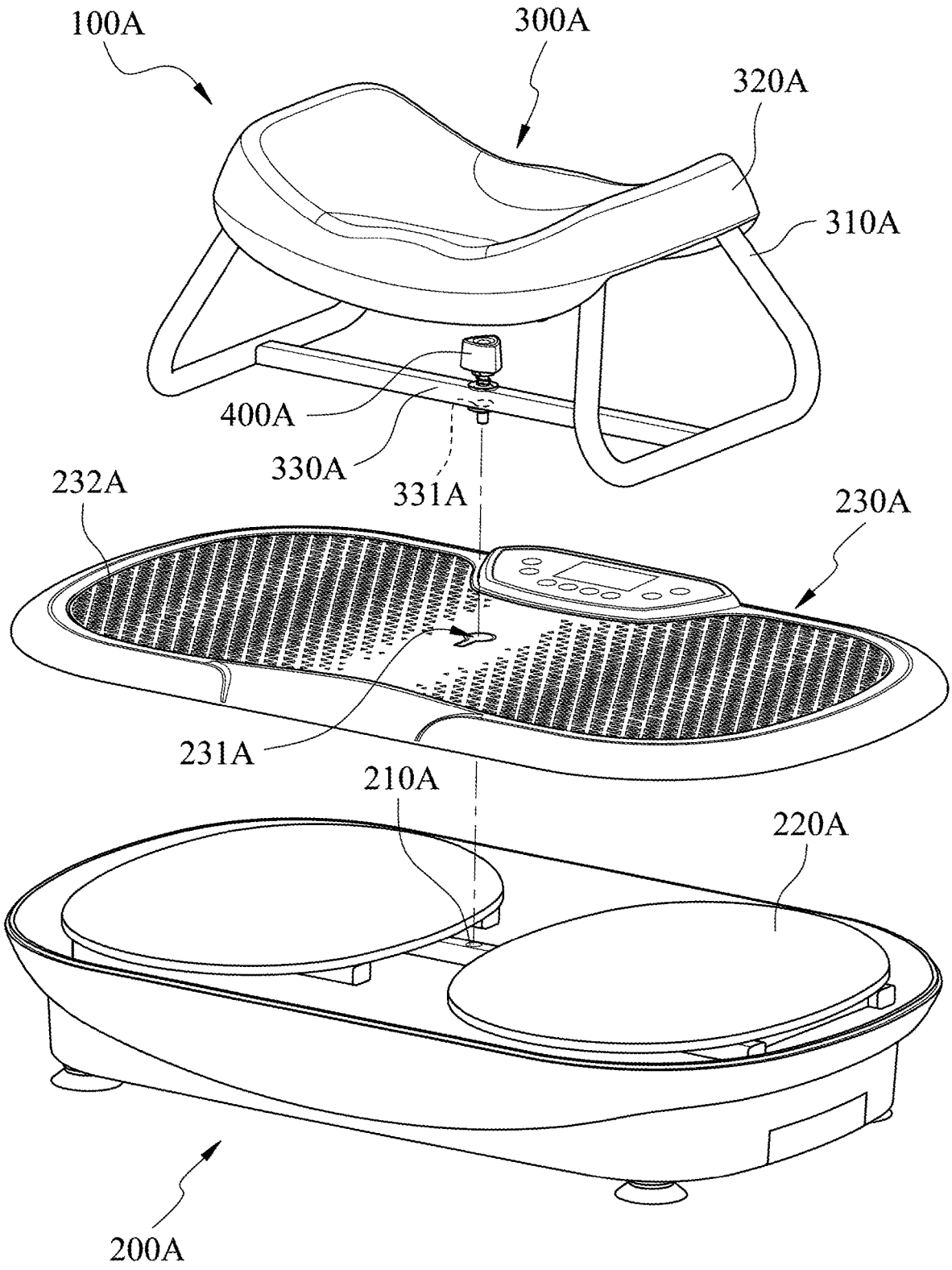
FIG. 5 is a partial exploded view of a vibrating fat eliminating device according to another embodiment of the present disclosure.

FIG. 5 is a partial exploded view of a vibrating fat eliminating device 100A according to another embodiment of the present disclosure. The vibrating fat eliminating device 100A of FIG. 5 is similar to the vibrating fat eliminating device 100 in FIG. 1 so that the details of the same elements will not be described again. As shown in FIG. 5, the vibrating fat eliminating device 100A includes a vibrating mainbody 200A, a chair body 300A and a positioning unit 400A, wherein the vibrating mainbody 200A includes a fixing notch 210A, an upper surface 220A and an upper cover 230A. The upper cover 230A is detachably disposed on the upper surface 220A and has an opening 231A, and the positioning unit 400A passes through in order from the through hole 331A of the connecting portion 330A of the chair body 300A to the opening 231A, and then is connected to the fixing notch 210A. By the disposition of the upper cover 230A, the fixing notch 210A can be disposed within the vibrating mainbody 200A so as to prevent dust or debris from entering the fixing notch 210A and further affecting the fixing efficiency of the chair body 300A, and the appearance of the vibrating fat eliminating device 100A can be also improved. Furthermore, the upper cover 230A includes a skidproof pad 232A disposed on a surface of the upper cover 230A close to the chair body 300A. The skidproof pad 232A can provide frictional force to the upper cover 230A so as to prevent the chair body 300A from shaking related to the vibrating mainbody 200A during the operation of the vibrating fat eliminating device 100A so that it is favorable for enhancing the assembling stability of the chair body 300A.

Figure 6:
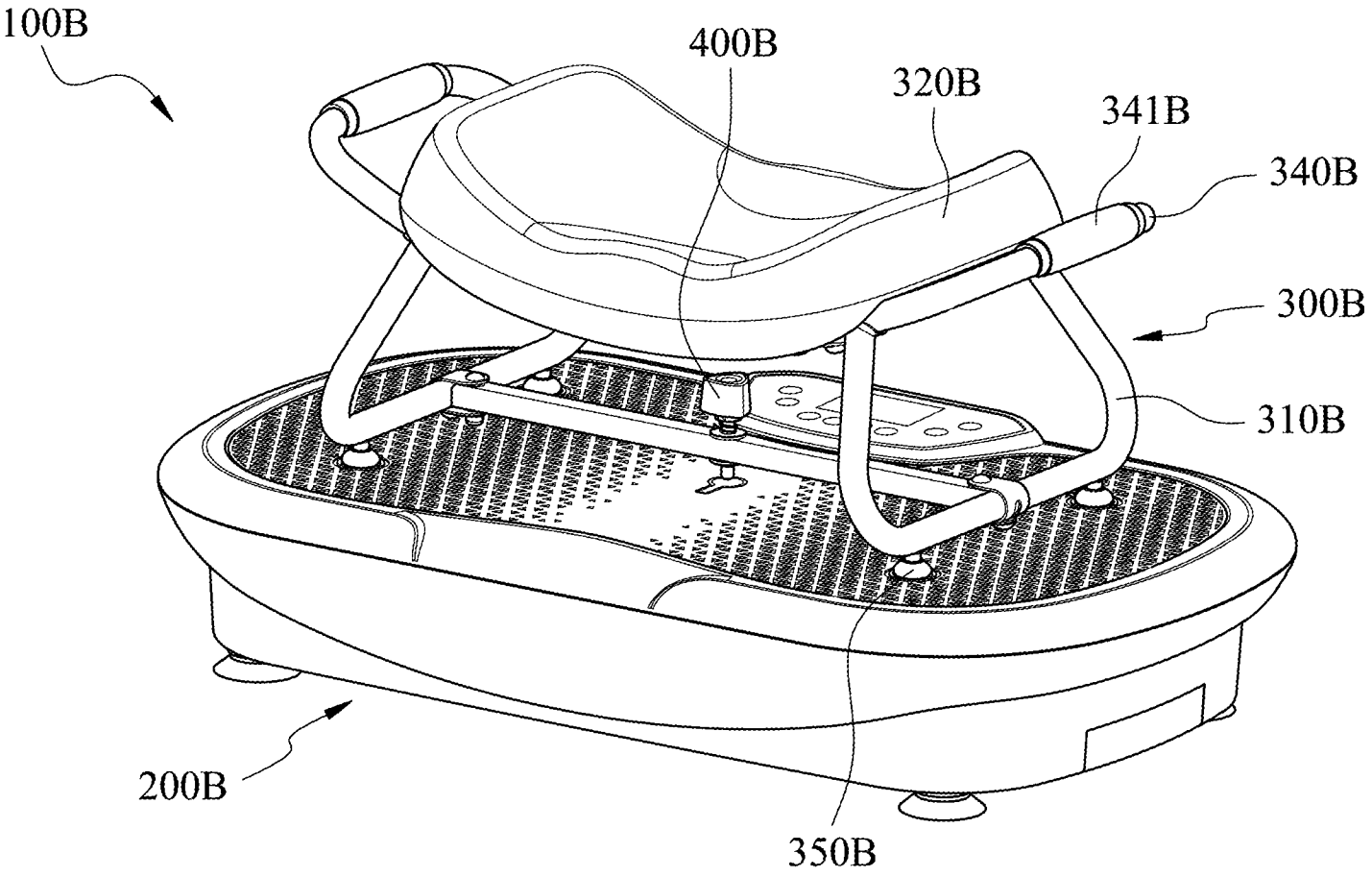
FIG. 6 is a schematic view of a vibrating fat eliminating device according to further another embodiment of the present disclosure.

FIG. 6 is a schematic view of a vibrating fat eliminating device 100B according to further another embodiment of the present disclosure. The vibrating fat eliminating device 100B of FIG. 6 is similar to the vibrating fat eliminating device 100 in FIG. 1 so that the details of the same elements will not be described again. As shown in FIG. 6, the vibrating fat eliminating device 100B includes a vibrating mainbody 200B, a chair body 300B and a positioning unit 400B. The chair body 300B includes a supporting frame 310B and a cushion 320B, wherein the supporting frame 310B includes two armrests 340B, and each of the armrests 340B includes a skidproof sheath 341B and a mounting portion (reference number is not shown), and the skidproof sheath 341B is disposed on the mounting portion of the armrest 340B. Moreover, as shown in FIG. 6, each of the armrests 340B is disposed on two sides of the supporting frame 310B, respectively. Therefore, the arrangement of the armrests 340B is favorable for grasping by the user so that the user can more stably sit on the chair body 300B. Furthermore, the chair body 300B can further include a plurality of foot stands; specifically, according to the embodiment of FIG. 6, the chair body 300B further includes four foot stands 350B, and the foot stands 350B are disposed separately from each other on a side of the support frame 310B close to the vibrating mainbody 200B. Therefore, by the arrangement of the foot stands 350B, the user can stably sit on the chair body 300B so that it is favorable for increasing the using safety of vibrating fat eliminating device 100B as well as enhancing the transmission of the vibrating wave during the operation of the vibrating fat eliminating device 100B so as to enhance the efficiency of body training or massage of the vibrating fat eliminating device 100B.

Figure 7:
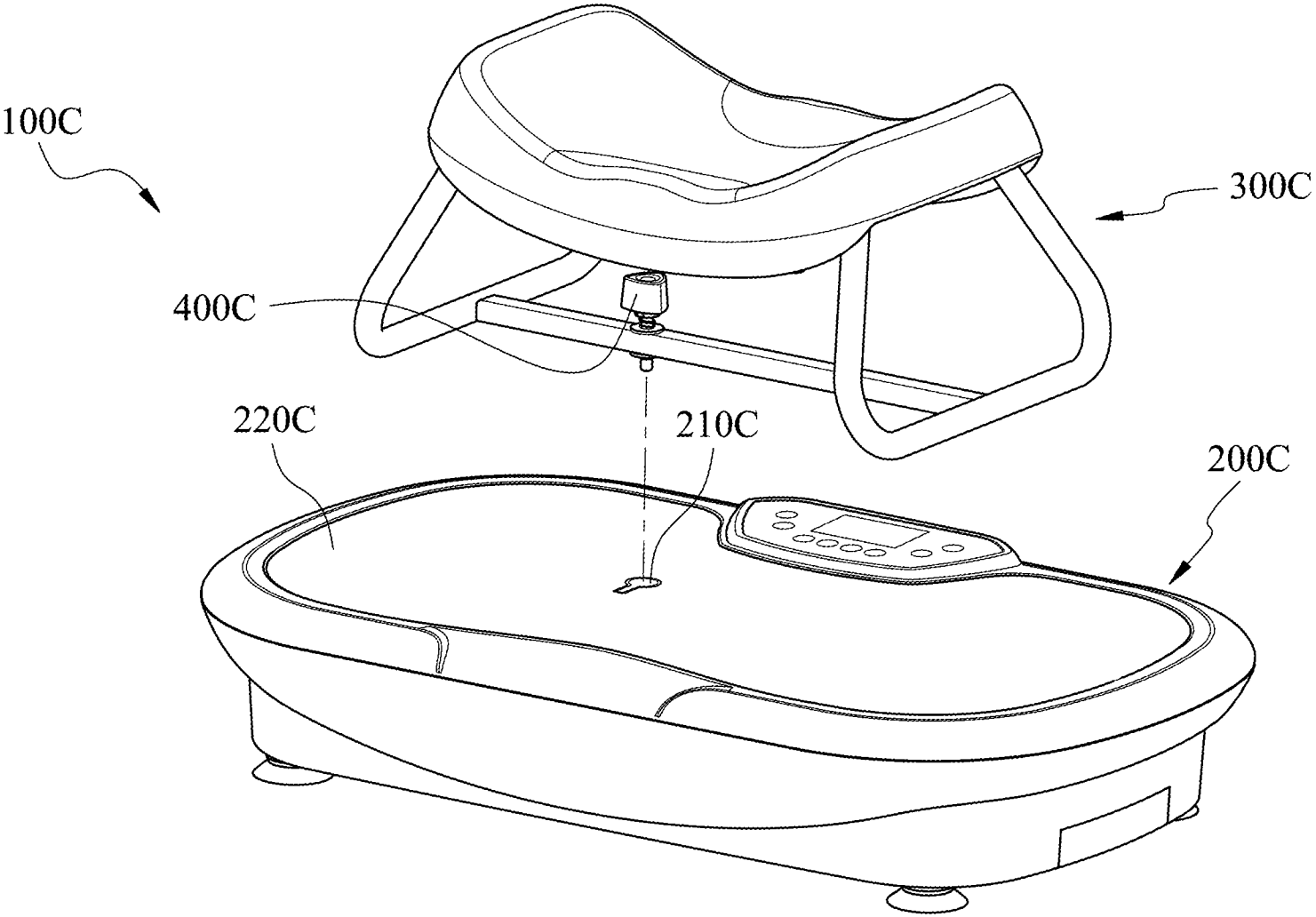
FIG. 7 is an assembling schematic view of a vibrating fat eliminating device according to still another embodiment of the present disclosure.

FIG. 7 is an assembling schematic view of a vibrating fat eliminating device 100C according to still another embodiment of the present disclosure. The vibrating fat eliminating device 100C of FIG. 7 is similar to the vibrating fat eliminating device 100 in FIG. 1 so that the details of the same elements will not be described again. As shown in FIG. 7, the vibrating fat eliminating device 100C includes a vibrating mainbody 200C, a chair body 300C and a positioning unit 400C. The vibrating mainbody 200C includes a fixing notch 210C and an upper surface 220C, wherein the fixing notch 210C is eccentrically disposed on the upper surface 220C, and the chair body 300C is detachably and eccentrically disposed on the vibrating mainbody 200C via the positioning unit 400C. Therefore, using the single positioning unit 400C to connect the chair body 300C on the vibrating mainbody 200C can greatly reduce the assembling complexity of the chair body 300C, and a seating place on the vibrating fat eliminating device 100C can be provided by the disposition of the vibrating mainbody 200C on the chair body 300C via the positioning unit 400C so that the user can use the vibrating fat eliminating device 100C without maintaining in a standing posture for a long time so as to achieve the purposes of body training or massage.

According to the aforementioned embodiments, the present disclosure has the advantages described bellowing. First, by the disposition of the vibrating mainbody, the chair body and the positioning unit, a seating place can be provided on the vibrating fat eliminating device, so that the user who is unable to maintain a standing posture for a long time can use the vibrating fat eliminating device of the present disclosure in a sitting posture for body training or massage. Second, single positioning unit is connected to the fixing notch disposed eccentrically on the upper surface or disposed on the center of the upper surface so as to connect the chair body to the upper surface of the vibrating mainbody, and it is favorable for reducing the assembling complexity of the chair body as well as enhancing the transmission of the vibrating wave during the operation of the vibrating fat eliminating device so as to enhance the efficiency of body training or massage of the vibrating fat eliminating device. Third, by the disposition of the supporting frame of chair body including an arc portion and the cushion with arc-shaped, the chair body can be suitable for the hip shape when the user sits thereon, so that the user can stably sit on the chair body. Furthermore, the using safety of the vibrating fat eliminating device 100 can be further enhanced by the chair body including the armrests disposed on two sides of the supporting frame 310B, respectively. Fourth, the demands of standing training mode and sitting training mode of the vibrating fat eliminating device can be satisfied by the disposition of the detachable chair body, and it is favorable for providing the user with different body training or massage modes so as to improve the application freedom of the vibrating fat eliminating device of the present disclosure.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A vibrating fat eliminating device, comprising:

a vibrating mainbody comprising a fixing notch and an upper surface, wherein the fixing notch is disposed on the upper surface;

a chair body detachably disposed on the vibrating mainbody and comprising a supporting frame and a cushion, wherein the supporting frame is disposed on the upper surface, the cushion is disposed on the supporting frame, and the supporting frame comprises a connecting portion having a through hole; and a positioning member passing through the through hole and connected to the fixing notch correspondingly, wherein the chair body is detachably disposed on the upper surface via the positioning member;

wherein the fixing notch comprises an internal connecting portion, the positioning member comprises a fixing rod, an elastic member and at least two washers, and the fixing rod passes through in order from the elastic member, one of the washers, the through hole and the other of the washers, and then is connected to the fixing notch;

wherein the fixing rod comprises a connecting end for connecting with the internal connecting portion, and the positioning member further comprises a knob disposed on one side of the fixing rod which is different from the connecting end;

wherein there is a single one of the fixing notch, the fixing notch is disposed at a center of the upper surface of the vibrating mainbody, and there is a single one of the positioning member which goes through a center portion of the connecting portion and is received by the fixing notch;

wherein the supporting frame comprises:

an arc portion on which the cushion is disposed; and two leg portions extending downwardly from the arc portion at opposite ends of the arc portion;

wherein the connecting portion extends from one of the two leg portions to the other of the two leg portions;

wherein the connecting portion has a length substantially equal to a distance between bottoms of the leg portions, and the through hole is formed at approximately the center portion of the connecting portion along the length of the connecting portion.

2. The vibrating fat eliminating device of claim 1, wherein the fixing notch is eccentrically disposed on the upper surface, and the chair body is detachably and eccentrically disposed on the upper surface of the vibrating mainbody via the positioning member.

3. The vibrating fat eliminating device of claim 1, wherein the vibrating mainbody further comprises an upper cover detachably disposed on the upper surface and having an opening, and the positioning member passes through in order from the through hole to the opening, and then is connected to the fixing notch.

4. The vibrating fat eliminating device of claim 3, wherein the upper cover comprises a skidproof pad disposed on a surface of the upper cover close to the chair body.

5. The vibrating fat eliminating device of claim 1, wherein a shape of the cushion is arc-shaped corresponding to the arc portion.

6. The vibrating fat eliminating device of claim 1, wherein the supporting frame further comprises two armrests disposed on two sides of the supporting frame, respectively.

7. The vibrating fat eliminating device of claim 6, wherein each of the armrests comprises a skidproof sheath and a mounting portion, and the skidproof sheath is disposed on the mounting portion of the armrest.

8. The vibrating fat eliminating device of claim 1, wherein the chair body further comprises a plurality of foot stands, and the foot stands are disposed separately from each other on a side of the support frame close to the vibrating mainbody.

9. The vibrating fat eliminating device of claim 1, wherein the elastic member is a spring.

* * * * *